US009520230B2

(12) United States Patent
Sakuma et al.

(10) Patent No.: US 9,520,230 B2
(45) Date of Patent: Dec. 13, 2016

(54) PRODUCTION METHOD OF RARE EARTH MAGNET

(75) Inventors: Noritsugu Sakuma, Toyota (JP); Hidefumi Kishimoto, Toyota (JP); Akira Kato, Toyota (JP); Tetsuya Shoji, Toyota (JP); Dominique Givord, Grenoble (FR); Nora Dempsey, Grenoble (FR); Thomas George Woodcock, Dresden (DE); Oliver Gutfleisch, Darmstadt (DE); Gino Hrkac, Exeter (GB); Thomas Schrefl, Herzogenburg (AT)

(73) Assignees: TOYOTA JIDOSHA KABUSHIKI KAISHA, Aichi-ken (JP); CENTRE NATIONAL DE LA RECHERCHE SCIENTIFIQUE, Paris (FR); LEIBNIZ INSTITUTE FOR SOLID STATE AND MATERIALS RESEARCH DRESDEN, Dresden (DE); UNIVERSITY OF SHEFFIELD, Sheffield (GB)

( * ) Notice: Subject to any disclaimer, the term of this patent is extended or adjusted under 35 U.S.C. 154(b) by 651 days.

(21) Appl. No.: 13/824,572

(22) PCT Filed: May 13, 2011

(86) PCT No.: PCT/JP2011/061608

§ 371 (c)(1),
(2), (4) Date: May 15, 2013

(87) PCT Pub. No.: WO2012/056755

PCT Pub. Date: May 3, 2012

(65) Prior Publication Data

US 2013/0248754 A1 Sep. 26, 2013

(30) Foreign Application Priority Data

Oct. 25, 2010 (EP) ..... 10306166

(51) Int. Cl.
*H01F 41/00* (2006.01)
*H01F 41/02* (2006.01)
(Continued)

(52) U.S. Cl.
CPC ..... *H01F 41/00* (2013.01); *C22C 38/002* (2013.01); *C22C 38/005* (2013.01); *C22C 38/06* (2013.01);
(Continued)

(58) Field of Classification Search
CPC ..... H01F 1/0306; H01F 1/01; H01F 41/00; H01F 41/005
See application file for complete search history.

(56) References Cited

U.S. PATENT DOCUMENTS 5,055,142 A 10/1991 Perrier De La Bathie et al.
5,405,455 A 4/1995 Kusunoki et al.
(Continued)

FOREIGN PATENT DOCUMENTS

CN 1735947 A 2/2006
CN 101640087 A 2/2010
(Continued)

OTHER PUBLICATIONS

Lee, R. W. "Hot-pressed neodymium-iron-boron magnets." Applied Physics Letters 46.8 (1985): 790-791.*
(Continued)

*Primary Examiner* — Jessee Roe
(74) *Attorney, Agent, or Firm* — Sughrue Mion, PLLC

(57) ABSTRACT

A rare earth magnet, which is represented by a neodymium magnet ($Nd_2Fe_{14}B$) and neodymium magnet films with applications in micro-systems. A method for producing a rare earth magnet, comprising: (a) quenching a molten metal having a rare earth magnet composition to form quenched flakes of nanocrystalline structure; sintering the quenched
(Continued)

flakes; subjecting the sintered body obtained to an orientation treatment; and applying a heat treatment with pressurization at a temperature sufficiently high to enable diffusion or fluidization of a grain boundary phase and at the same time, low enough to prevent coarsening of the crystal grains, (b) thick films deposited on a substrate, applying an annealing to crystallize with pressurization at a temperature sufficiently high to enable diffusion or fluidization of a grain boundary phase and, at the same time, low enough to prevent coarsening of the crystal grains.

14 Claims, 11 Drawing Sheets

(51) Int. Cl.

| | |
|---|---|
| ***H01F 41/32*** | (2006.01) |
| ***C22C 38/00*** | (2006.01) |
| ***C22C 38/06*** | (2006.01) |
| ***C22C 38/16*** | (2006.01) |
| ***H01F 1/01*** | (2006.01) |
| *H01F 1/057* | (2006.01) |
| *H01F 10/12* | (2006.01) |
| *B22F 3/24* | (2006.01) |

(52) U.S. Cl.

CPC ..... *C22C 38/16* (2013.01); *H01F 1/01* (2013.01); *H01F 41/005* (2013.01); *H01F 41/0273* (2013.01); *H01F 41/32* (2013.01); *B22F 2003/248* (2013.01); *B22F 2998/00* (2013.01); *B22F 2998/10* (2013.01); *B22F 2999/00* (2013.01); *C22C 2202/02* (2013.01); *H01F 1/0576* (2013.01); *H01F 1/0577* (2013.01); *H01F 10/126* (2013.01)

(56) References Cited

U.S. PATENT DOCUMENTS

| | | | |
|---|---|---|---|
| 2004/0025974 | A1 | 2/2004 | Lee et al. |
| 2008/0274009 | A1 | 11/2008 | Tomizawa |
| 2009/0218012 | A1 | 9/2009 | Hioki et al. |
| 2010/0003156 | A1 | 1/2010 | Suzuki et al. |

FOREIGN PATENT DOCUMENTS

| | | | |
|---|---|---|---|
| EP | 0 921 533 | A1 | 6/1999 |
| EP | 1 187 148 | A1 | 3/2002 |
| EP | 1 744 328 | A2 | 1/2007 |
| EP | 2 228 808 | A1 | 9/2010 |
| JP | 06-207203 | A | 7/1994 |
| JP | 06-207204 | A | 7/1994 |
| JP | 201142837 | A | 3/2011 |
| WO | 2008139559 | A1 | 11/2008 |
| WO | 2012008623 | A1 | 1/2012 |

OTHER PUBLICATIONS

Yanguo Liu, et al., "Bulk anisotropic $Nd_2Fe_{14}B/\alpha$-Fe nanocomposite magnets prepared by hot-deformation processing of amorphous alloys", Journal of Applied Physics 106, 2009, pp. 113918-1-113918-6, vol. 106, No. 11.

L. Castaldi, et al., "Growth and characterization of NdFeB thin films", Journal of Magnetism and Magnetic Materials, 2002, pp. 1284-1286, vol. 242-245.

* cited by examiner (A)

(B)

(A)

(B)

PRODUCTION METHOD OF RARE EARTH MAGNET

CROSS REFERENCE TO RELATED APPLICATIONS

This application is a National Stage of International Application No. PCT/JP2011/061608 filed May 13, 2011, claiming priority based on European Patent Application No. 10306166.9 filed Oct. 25, 2010, the contents of all of which are incorporated herein by reference in their entirety.

TECHNICAL FIELD

The present invention relates to a production method of a rare earth magnet, which is usually represented by a neodymium magnet and neodymium magnet films which apply to MEMS (Micro Electro Mechanical Systems). More specifically, the present invention relates to a production method of a rare earth magnet having a structure composed of nano-size crystal grains.

BACKGROUND ART

A rare earth magnet, which is represented by a neodymium magnet ($Nd_2Fe_{14}B$) and neodymium magnet films which apply to MEMS (Micro Electro Mechanical Systems), is used as a very strong permanent magnet having a high magnetic flux density for various applications. In order to further increase the magnetic coercive force, the crystal grain size is being reduced to the nano-scale (several tens to several hundreds of nm).

In typical sintered magnets (crystal grain size: several μm or more), as is known, a heat treatment is applied after sintering so as to increase the magnetic coercive force. For example, in Patent Documents 1 and 2, it is confirmed that the magnetic coercive force can be enhanced, when an aging heat treatment at a temperature of not more than the sintering temperature is applied.

However, it is unknown whether the above-described effect would be obtained in a magnet composed of nano-size crystal grains. That is, the fineness of the structure is considered to greatly contribute to the increase of magnetic coercive force, and therefore a heat treatment has not been performed because of the risk of coarsening the crystal grain.

In a rare earth magnet having a nanocrystalline structure, the enhancement of the magnetic coercive force by a heat treatment is desirable. Accordingly, it is needed to establish an optimal heat treatment method.

RELATED ART

Patent Document

[Patent Document 1] Japanese Unexamined Patent Publication No. 6-207203

[Patent Document 2] Japanese Unexamined Patent Publication No. 6-207204

SUMMARY OF THE INVENTION

Problems to be Solved by the Invention

An object of the present invention is to provide a production method of a rare earth magnet, which is usually represented by a neodymium magnet ($Nd_2Fe_{14}B$) and neodymium magnet films which apply to MEMS (Micro Electro Mechanical Systems), wherein a heat treatment method capable of enhancing the magnetic characteristics, particularly the magnetic coercive force is used.

Means to Solve the Problems

In order to attain the above-described object, the present invention provides a method for producing a rare earth magnet, comprising:

applying a heat treatment with pressurization to an article having a rare earth magnet composition at a temperature sufficiently high to enable diffusion or fluidization of a grain boundary phase and, at the same time, low enough to prevent coarsening of the crystal grains.

The term "with pressurization" refers to all methods to apply a pressure or a stress.

More specifically, in one embodiment, the present invention provides a method for producing a rare earth magnet in the form of a bulk, comprising:

quenching a molten metal having a rare earth magnet composition to form quenched flakes having a nanocrystalline structure, sintering the quenched flakes, subjecting the sintered body obtained to an orientation treatment, and applying a heat treatment with pressurization to the orientation-treated sintered body at a temperature sufficiently high to enable diffusion or fluidization of a grain boundary phase and, at the same time, low enough to prevent coarsening of the crystal grains.

In a preferred embodiment of the present invention, an element, which is capable of lowering the temperature at which the grain boundary phase can be diffused or fluidized, is added to the rare earth magnet composition.

Typically, the rare earth magnet composition is $Nd_{15}Fe_{77}B_7Ga$, the main phase of the rare earth magnet is $Nd_2Fe_{14}B$, and an element, which is capable of alloying with Nd and thereby lowering the temperature at which the grain boundary phase can be diffused or fluidized, is added to the rare earth magnet composition $Nd_{15}Fe_{77}B_7Ga$ in an amount sufficiently large to bring about the effect of lowering the temperature and small enough to cause no deterioration of magnetic characteristics and hot workability.

Preferably, the orientation treatment is a hot working.

In another embodiment, the present invention provides a method for producing a rare earth magnet in the form of a film, comprising:

depositing a film having a rare earth magnet composition on a substrate, and applying a heat treatment with pressurization to the film for crystallization at a temperature sufficiently high to enable diffusion for fluidization of a grain boundary phase and, at the same time, low enough to prevent coarsening of the crystal grains.

Effects of the Invention

In the present invention, a heat treatment is applied with pressurization at a temperature sufficiently high to enable diffusion or fluidization of a grain boundary phase and, at the same time, low enough to prevent coarsening of the crystal grain size. Upon this treatment, a grain boundary phase unevenly distributed in the space formed among crystal grains and at triple points, that is, at a portion where three or more crystal grains are joined, is re-distributed to the entire grain boundary in order to create the state wherein a nano-size main phase crystal grain is covered with a grain boundary phase to prevent the exchange coupling between main phase grains and thereby to enhance the magnetic coercive force.

MODE FOR CARRYING OUT THE INVENTION

Conventionally, enhancement of the magnetic coercive force by a heat treatment is effective for a rare earth magnet having a crystal structure in the micron range, but heat treatments are avoided for rare earth magnets having a nanocrystalline structure because of a large risk of coarsening the grain structure.

According to the present invention, the magnetic coercive force can be enhanced, while preventing coarsening of the structure due to heat treatment.

According to the present invention, the heat treatment is applied to a rare earth magnet which has a rare earth magnet composition configured to have a nanocrystalline structure, and has been subjected to an orientation treatment. These requirements are described below.

First Embodiment

Composition

One representative example of the rare earth magnet composition is indicated by the following compositional formula:

$$R^1_vFe_wCo_xB_yM^1_z$$

$R^1$: one or more kinds of rare earth elements including Y, $M^1$: at least one of Ga, Zn, Si, Al, Nb, Zr, Ni, Cu, Cr, Hf, Mo, P, C, Mg and V, $13 \le v \le 20$, $w = 100 - v - x - y - z$, $0 \le x \le 30$, $4 \le y \le 20$, $0 \le z \le 3$.

Preferably, in the compositional formula $R^1_vFe_wCo_xB_yM^1_z$, the amount v of $R^1$ (one or more kinds of rare earth elements including Y) is $13 \le v \le 17$ and the amount y of B is $5 \le y \le 16$.

Another representative example of the rare earth magnet composition is indicated by the following compositional formula, and composed of a main phase ($(R^2R^3)_2(FeCo)_{14}B$) and grain boundary phases ($(R^2R^3)(FeCo)_4B_4$ phase and $R^2R^3$ phase):

$$R^2_aR^3_bFe_cCo_dB_eM^2_f$$

$R^2$: one or more kinds of rare earth elements including Y (excluding Dy and Tb), $R^3$: one or more kinds of heavy rare earth elements consisting of Dy and Tb $M^2$: at least one of Ga, Zn, Si, Al, Nb, Zr, Ni, Cu, Cr, Hf, Mo, P, C, Mg, Hg, Ag and Au, $13 \le a \le 20$, $0 \le b \le 4$, $c = 100 - a - b - d - e - f$, $0 \le d \le 30$, $4 \le e \le 20$, $0 \le f \le 3$, <Nanocrystalline Structure>

A molten metal having a rare earth magnet composition is quenched to form flakes having a structure composed of nanocrystals (nanocrystalline structure). The nanocrystalline structure is a polycrystalline structure where the crystal grain is of nano size. The nano size is a size in the range 10 to 300 nm.

The quenching rate is in the range suitable for allowing the solidified structure to become a nanocrystalline structure. If the quenching rate is less than this range, the solidified structure becomes a coarse crystal structure, and thereby a nanocrystalline structure is not obtained. If the quenching rate is more than this range, the solidified structure is amorphous, and thereby a nanocrystalline structure is not obtained.

Figure 1:
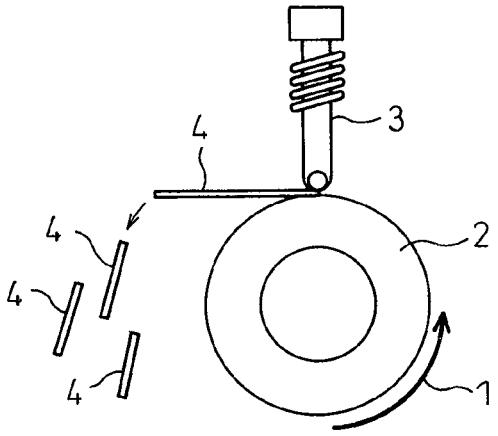
FIG. 1 schematically shows the method for producing quenched flakes by a single roll method.

The method for quenching solidification need not be particularly limited, but this is preferably performed by using a single-roll furnace shown in FIG. 1. When a molten alloy is ejected out from a nozzle (3) on the outer circumferential surface of a single roll (2) rotating in the direction of the arrow (1), the molten alloy is quenched and solidified, and thereby becomes flakes (4). In the single roll method, quenched flakes are formed by solidification due to one-direction solidification from the roll's outer circumferential surface with which the flake is in contact, out towards the free (outer) surface of the flake, and therefore a low melting-point phase is formed on the free surface of a flake (last solidified part). The presence of a low melting-point phase on the flake surface is very advantageous for low-temperature sintering, because a sintering reaction occurs at a low temperature in the sintering step. As compared with this method, in a twin roll method, because solidification occurs from both surfaces of a flake towards the center part of the flake, a low melting point phase is formed not on the surface but in the center part of the flake. Therefore, in this case, a low-temperature sintering effect between flakes is not obtained.

In general, when a molten alloy is quenched so as to produce a nanocrystalline structure and to avoid production of a coarse crystal structure, the quenching rate tends to fluctuate to a higher rate than appropriate. Therefore, as a result, individual quenched flakes have either a nanocrystalline structure or an amorphous structure. In this case, quenched flakes of nanocrystalline structure needs to be selected from the mixture of the quenched flakes having different structures.

Figure 2:
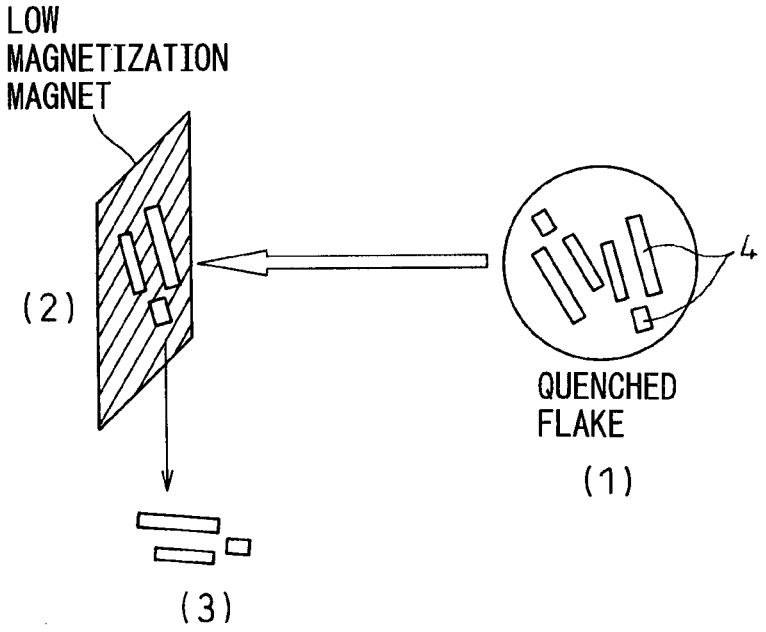
FIG. 2 schematically shows the method for separating the quenched flakes into amorphous flakes and crystalline flakes.

Therefore, as shown in FIG. 2, the quenched flakes are separated into crystalline flakes and amorphous flakes by using a low magnetization magnet. More specifically, out of a collection of quenched flakes (1), amorphous quenched flakes are magnetized by the magnet and kept from falling (2), whereas crystalline quenched flakes are not magnetized by the magnet and are allowed to fall (3).

<Sintering>

The produced (if desired, separated) quenched flakes of nanocrystalline structure are sintered. The sintering need not be particularly limited in its method, but must be performed at a low temperature in as short a time as possible so as to prevent coarsening of the nanocrystalline structure. Accordingly, it is necessary to perform the sintering under pressure. By performing the sintering under pressure, the sintering reaction is accelerated and thereby low-temperature sintering becomes possible, so that the nanocrystal structure can be maintained.

In order to prevent the crystal grain of sintered structure from being coarsened, the heating rate to the sintering temperature is also preferably high.

From these standpoints, sintering by electric current (resistance) heating with pressurization, for example, sintering commonly referred to as "Spark Plasma Sintering (SPS)" is preferred. Under pressurization, more electric current can pass so that the sintering temperature can be lowered, and the temperature can be raised to the sintering temperature in a short time. Therefore, this technique is most advantageous in maintaining the nanocrystalline structure.

However, sintering need not be limited to SPS sintering, and may also be performed by using a hot press.

As a type of hot press, it is also possible to use a normal press molding machine or the like in combination with high frequency heating and heating with an attached heater. In high frequency heating, the work piece is directly heated by using an insulating die/punch tool, or the work piece is indirectly heated by the heated die/punch after heating the dye/punch by using an electrically conductive die/punch tool. In heating with an attached heater, the die/punch tool is heated with a cartridge heater, a band heater or the like.

<Orientation Treatment>

The obtained sintered body is subjected to an orientation treatment. A representative method for the orientation treatment is a hot working. In particular, severe plastic deformation where the working degree, i.e., the decrease in thickness of the sintered body, is 30% or more, 40% or more, 50% or more, or 60% or more, is preferred.

By subjecting the sintered body to a hot working (e.g., rolling, forging, extrusion processing), the crystal grain itself and/or the crystal direction in the crystal grain are rotated in association with slide deformation, and thereby the sintered body is oriented (development of texture) in the easy direction of magnetization in the case of a hexagonal or tetragonal crystal, the c axis direction). When the sintered body has a nanocrystalline structure, the crystal grain itself and/or the crystal direction in the crystal grain are easily rotated and thereby the orientation is accelerated. As a result, a fine aggregate structure having highly-oriented nano-size crystal grains is achieved, and an anisotropic rare earth magnet remarkably enhanced in the remnant magnetization while maintaining high magnetic coercive force is obtained. Also, due to the homogeneous crystal structure composed of nano-size crystal grains, good squareness is obtained.

However, the method for the orientation treatment is not limited to a hot working, and may be sufficient if the crystal grains can be oriented while maintaining the nanocrystal structure. For example, there is a method where anisotropic powder (e.g., Hydrogenation-Disproportionation-Desorption-Recombination (HDDR)-treated powder) is compacted into a solid in a magnetic field and then sintered under pressure.

<Heat Treatment>

After the orientation treatment, which may include sintering, a heat treatment with pressurization, which is the characteristic feature of the present invention, is applied. During the heat treatment, decrease in thickness of the orientation-treated sintered body is not substantial, for example the decrease in thickness is 5% or less, 3% or less, or 1% or less.

The heat treatment with pressurization is performed so as to cause a grain boundary phase, which is unevenly distributed mainly in the triple points of the grain boundaries, to diffuse or fluidize along the entire grain boundary. The heating is associated with pressurization, so that diffusion or fluidization of the grain boundary phase can be accelerated, while suppressing the grain growth incurred by the heat treatment. Also, due to pressurization associated with the heating, the grain boundary phase, which is unevenly distributed mainly in the triple points among crystal grains of the main phase, can be extruded from the triple points, and thereby diffusion or fluidization of the grain boundary phase can be accelerated.

When the grain boundary phase is unevenly distributed at the triple points, a grain boundary phase between adjacent main phases does not exist (or does not exist in a sufficient amount) in some place. In such places, exchange coupling across a plurality of main phase grains increases the effective main phase size, as a result, the magnetic coercive force is low. When a grain boundary phase is present in a sufficient amount between adjacent main phases, the exchange coupling between adjacent main phases is prevented by the grain boundary phase, and thereby the effective main phase size remains small, so that a high magnetic coercive force can be obtained.

The temperature of the heat treatment with pressurization is a temperature sufficiently high to enable diffusion or fluidization of the grain boundary phase, and at the same time, low enough to prevent coarsening of the crystal grains. Typically, the melting point of the grain boundary phase is the index of the temperature enabling diffusion or fluidization of a grain boundary phase. Accordingly, for example, in the case of neodymium magnets, the lower limit of the heat treatment temperature is in the vicinity of the melting point of the grain boundary phase, for example Nd—Cu phase, and the upper limit of the heat treatment temperature is a temperature allowing no coarsening of the main phase, for example $Nd_2Fe_{14}B$ phase, that is, for example, 700° C. Incidentally, as described below, the melting point of the grain boundary phase can be lowered by the addition of an additive element. More specifically, for example, in the case of a neodymium magnet, the heat treatment temperature can be selected from the range of 450 to 700° C.

The pressure applied to the sintered body during the heat treatment with pressurization can be 1 MPa or more, 5 MPa or more, 10 MPa or more, or 40 MPa or more, and 100 MPa or less, 150 MPa or less, 200 MPa or less, or 300 MPa or less. The time of heat treatment with pressurization can be 1 minute or more, 3 minutes or more, 5 minutes or more, or 10 minutes or more, and 30 minutes or less, 1 hour or less, 3 hours or less, or 5 hours or less. The effect on the magnetic coercive force can be obtained even when this holding time is a relatively short time, for example, about 5 minutes.

Figure 3:
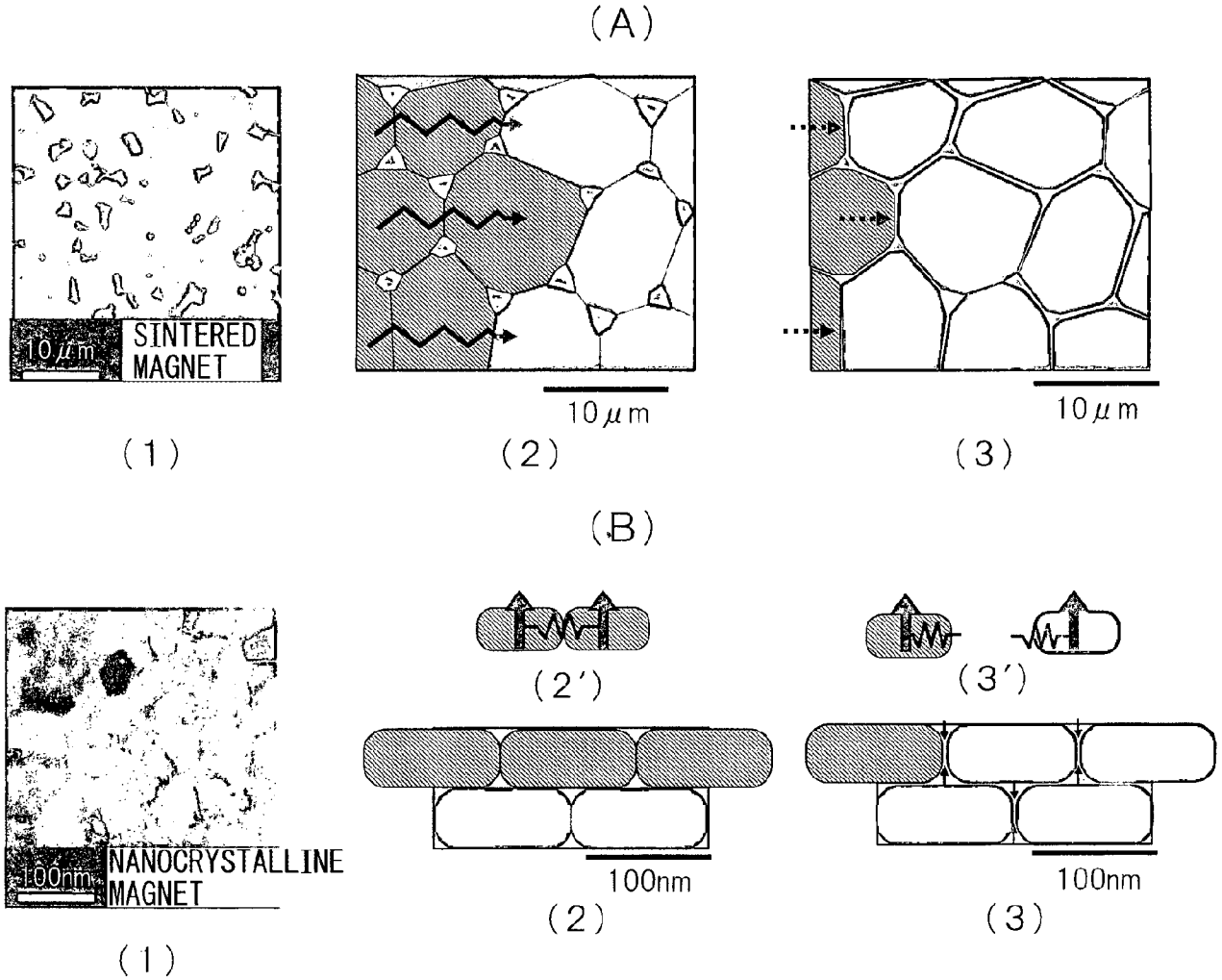
FIG. 3 schematically shows a comparison of a morphology change (movement) of a grain boundary phase due to heat treatment, with respect to (A) a conventional sintered magnet and (B) a nanocrystalline magnet of the present invention.

The operation and effect of the heat treatment are described by referring to FIG. 3.

FIG. 3 shows (1) a photograph of the structure before heat treatment, (2) a schematic image of the structure before heat treatment and (3) a schematic image of the structure after heat treatment, with respect to (A) a conventional sintered magnet and (B) a nanocrystalline magnet of the present invention. In the schematic images (2) and (3), the shaded crystal grains and the gray crystal grains are reversed in magnetization direction.

In the case of the conventional sintered magnet (A), before the heat treatment (2), the grain boundary phase is unevenly distributed at triple points of the crystal grain boundary, and a grain boundary phase does not exist or exists in a very small amount in the grain boundary other than at the triple points. Accordingly, the grain boundary does not act as a barrier against the movement of magnetic domain walls, and since the magnetic domain walls move to the adjacent crystal grains across the crystal grain boundary, a high magnetic coercive force is not obtained. After the heat treatment (3), the grain boundary diffuses or fluidizes from the triple points, and sufficiently permeates the grain boundary other than the triple points to cover the entire crystal grain. The grain boundary phase exists in a sufficient amount in the grain boundary to prevent the movement of magnetic domain walls, and thereby the magnetic coercive force is enhanced.

In the case of the nanocrystalline magnet (B) of the present invention, before the heat treatment (2), the grain boundary is unevenly distributed at the triple points of the crystal gain boundary, and a grain boundary phase does not exist or exists in a very small amount in the grain boundary other than the triplet point. Accordingly, the grain boundary does not act as a barrier against exchange coupling between adjacent crystal grains, and since adjacent crystal grains interact together through exchange coupling (2') to allow magnetization reversal in one crystal grain to induce magnetization reversal of the adjacent crystal grain, a high magnetic coercive force is not obtained. After the heat treatment (3), the grain boundary phase diffuses or fluidizes from the triple points, and sufficiently permeates the grain boundary other than the triple points to cover the entire crystal grain. The grain boundary phase exists in a sufficient amount in the grain boundary to prevent exchange coupling between adjacent crystal grains (3'), and therefore the magnetic coercive force is enhanced. Furthermore, due to a nanocrystalline structure, the grain boundary phase diffused or fluidized from the triple pints to cover the crystal grains in a very short time, so that the heat treatment time can be greatly reduced.

<Additive Element>

In a preferred embodiment of the present invention, an element capable of lowering the melting point of the grain boundary phase is added to the rare earth magnet composition. As a typical case, when the rare earth magnet composition is represented by the formula $R^1_vFe_wCo_xB_yM^1_z$ or $R^2_aR^3_bFe_cCo_dB_eM^2_f$, and at the same time an Nd-rich grain boundary phase is formed, for example when the rare earth magnet composition is represented by the formula $Nd_{15}Fe_{77}B_7Ga$ and the rare earth magnet is composed of a main phase $Nd_2Fe_{14}B$ and an Nd-rich grain boundary phase, an element capable of alloying with Nd and thereby lowering the temperature at which the grain boundary phase can be diffused or fluidized, is added to the rare earth magnet composition above in an amount sufficiently large to bring about the effect of lowering the temperature and small enough to cause no deterioration of magnetic characteristics and hot workability. Ga has been conventionally used as an element having an effect of decreasing the crystal grain size, particularly for suppressing the crystal grain growth during hot working.

Examples of the elements capable of alloying with Nd and thereby lowering the temperature at which the grain boundary phase can be diffused or fluidized include Al, Cu, Mg, Fe, Co, Ag, Ni and Zn. Among these, addition of Cu is preferred in order to lower the melting point of the grain boundary phase. Also, even though the addition of Al does not greatly affect the magnetic characteristics, its addition in a small amount is preferred in the mass production process. This is because its addition can lower the optimal temperature (or can expand the temperature range) at the heat treatment for optimization, and, in turn, expand the temperature range for the production of a nanocrystalline magnet. The amount of such an additive element to be added can be from 0.05 to 0.5 atm %, preferably from 0.05 to 0.2 atm %.

The eutectic temperatures (melting point of eutectic composition) of binary alloys of the element above and Nd are shown below, as compared with the melting point of Nd.

Nd: 1024° C. (melting point)
Nd—Al: 635° C.
Nd—Cu: 520° C.
Nd—Mg: 551° C.
Nd—Fe: 640° C.
Nd—Co: 566° C.
Nd—Ag: 640° C.
Nd—Ni: 540° C.
Nd—Zn: 630° C.

Second Embodiment

Deposition

A film having a rare earth magnet composition is deposited on a substrate by any kind of process such a chemical vapor deposition (CVD) and physical vapor deposition (PVD). The thickness of the film can be 0.50 μm or more, 1.00 μm or more, 2.00 μm or more, or 3.00 μm or more. Further, the thickness of the film can be 1000 μm or less, 100 μm or less, 50 μm or less, or 10 μm or less.

<Heat Treatment>

After the deposition of the film, a heat treatment with pressurization, which is the characteristic feature of the present invention, is applied. For this purpose, a difference in thermal expansion coefficients of the substrate and the film deposited thereon can be used.

The pressure applied to the film during the heat treatment with pressurization can be 1 MPa or more, 5 MPa or more, 10 MPa or more, 50 MPa or more, or 100 MPa or more, and 300 MPa or less, 400 MPa or less, or 500 MPa or less. The time of heat treatment with pressurization can be 1 minute or more, 3 minutes or more, 5 minutes or more, or 10 minutes or more, and 30 minutes or less, 1 hour or less, 3 hours or less, or 5 hours or less. The effect on the magnetic coercive force can be obtained even when this holding time is a relatively short time, for example, about 5 minutes.

Regarding the other features, such as the rare earth magnet composition, nanocrystalline structure, additive element, the description for the first embodiment can be referred.

EXAMPLES

Reference Examples 1 to 4

In Reference Examples 1 to 4 below, it is demonstrated that in the method of the present invention for producing a rare earth magnet, even when the heat treatment is not associated with pressurization, a rare earth magnet having an improved magnetic coercive force is obtained as compared with the conventional method involving no heat treatment.

Reference Example 1

A nanocrystalline rare earth magnet of the composition $Nd_{15}Fe_{77}B_7Ga_1$, and a nanocrystalline rare earth magnet of the composition comprising Al and Cu, i.e. $Nd_{15}Fe_{77}B_{6.8}Ga_{0.5}Al_{0.5}Cu_{0.2}$, were produced. The finally obtained structure is a nanocrystalline structure composed of a main phase: $Nd_2Fe_{14}B_1$ phase, and a grain boundary phase: Nd-rich phase (Nd or Nd oxide) or $Nd_1Fe_4B_4$ phase. Ga is enriched in the grain boundary phase to prevent the movement of grain boundaries and suppress the coarsening of crystal grains. Both Al and Cu alloy with Nd in the grain boundary phase, and enables diffusion or fluidization of the grain boundary phase.

<Production of Alloy Ingot>

Each raw material of Nd, Fe, B, Ga, Al and Cu was weighed to a predetermined amount so as to give the two above-described compositions, and melted in an arc melting furnace to produce an alloy ingot.

<Production of Quenched Flake>

The alloy ingot was melted in a radio-frequency furnace, and the obtained molten alloy was quenched by ejecting it out on the roll surface of a copper-made single roll as shown in FIG. 1. The conditions employed are as follows.

<<Quenching Solidification Conditions>>

Nozzle diameter: 0.6 mm

Clearance: 0.7 mm

Ejection pressure: 0.4 kg/cm$^3$

Roll speed: 2,350 rpm

Melting temperature: 1,450° C.

<Separation>

In the obtained quenched flakes (4), as described above, nanocrystalline flakes and amorphous flakes were mixed. Therefore, as shown in FIG. 2, the quenched flakes (4) were separated into nanocrystalline flakes and amorphous flakes by using a low magnetization magnet. More specifically, out of quenched flakes (4) of (1), amorphous quenched flakes were made of a soft magnetic material, and therefore easily magnetized by the magnet and kept from falling (2), whereas nanocrystalline quenched flakes were made of a hard magnetic material, and therefore not magnetized by the magnet and thus allowed to fall (3). Only fallen nanocrystalline quenched flakes were collected, and subjected to the following treatment.

<Sintering>

The obtained nanocrystalline quenched flakes were sintered by SPS under the following conditions.

<<SPS Sintering Conditions>>

Sintering temperature: 570° C.

Holding time: 5 minutes

Atmosphere: vacuum of $10^{-2}$ Pa

Surface pressure: 100 MPa

As above, a surface pressure of 100 MPa was imposed during the sintering. This is a large surface pressure exceeding the initial surface pressure of 34 MPa which ensures electric current. Using this large surface pressure, a sintered density of 98% (=7.5 g/cm$^3$) was obtained at a sintering temperature of 570° C. and a holding time of 5 minutes. In contrast to the conventional sintering without pressurization where a high temperature of about 1,100° C. is required to obtain the same sintered density, the sintering temperature could be greatly lowered.

However, a low melting point phase was formed on one surface of the quenched flakes by the use of the single roll method, and this also contributes to the low-temperature sintering. Specifically, the melting point of the main phase $Nd_2Fe_{14}B_1$ is 1,150° C., whereas the melting point of the low melting point phase is, for example, 1,021° C. for Nd and 786° C. for $Nd_3Ga$.

That is, in this Reference Example, the above-described low-temperature sintering at 570° C. could be achieved by the combination of the effect of lowering the sintering temperature due to the pressurization of the pressure sintering (surface pressure: 100 MPa), and the effect of lowering the sintering temperature due to the low melting point phase formed on one surface of the quenched flake.

<Hot Working>

As an orientation treatment, hot working was performed by using an SPS apparatus under the following severe plastic deformation conditions.

<<Hot Working Conditions>>

Working temperature: 650° C.

Working pressure: 100 MPa

Atmosphere: vacuum of $10^{-2}$ Pa

Working degree: 60%

<Heat Treatment>

The obtained severely plastically deformed material was cut into a 2-mm square shape, and subjected to a heat treatment under the following conditions.

<<Heat Treatment Conditions>>

Holding temperature: varied in the range of 300 to 700° C.

Heating rate from room temperature to holding temperature: 120° C./min (constant)

Holding time: 30 minutes (constant)

Cooling: quenching (Specifically, the sample was taken out from the heat treatment furnace in a glove box, and allowed to cool to the room temperature state in the glove box.)

Atmosphere: Ar gas (2 Pa)

<Evaluation of Magnetic Property>

Each of the samples comprising and not comprising Al and Cu was measured by VSM for magnetic characteristics, before and after heat treatment.

Figure 4:
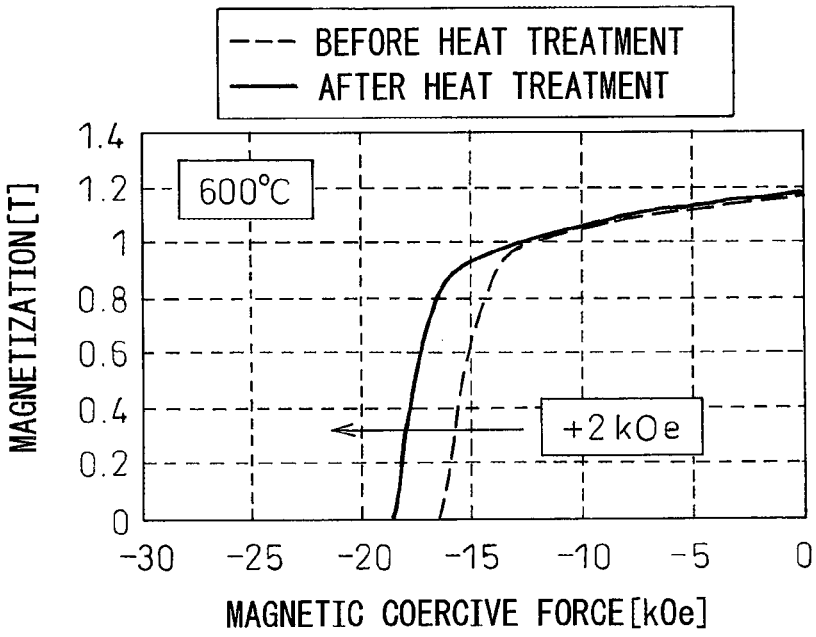
FIG. 4 shows a comparison of a magnetization curve before and after heat treatment of a rare earth magnet having a nanocrystalline structure of a composition comprising Al and Cu (Reference Example 1).

FIG. 4 shows magnetization curves (demagnetization curves) of a rare earth magnet comprising Al and Cu as a typical example before and after heat treatment at 600° C. It is seen that the magnetic coercive force was enhanced by 2 kOe from 16.6 kOe to 18.6 kOe by the heat treatment.

Figure 5:
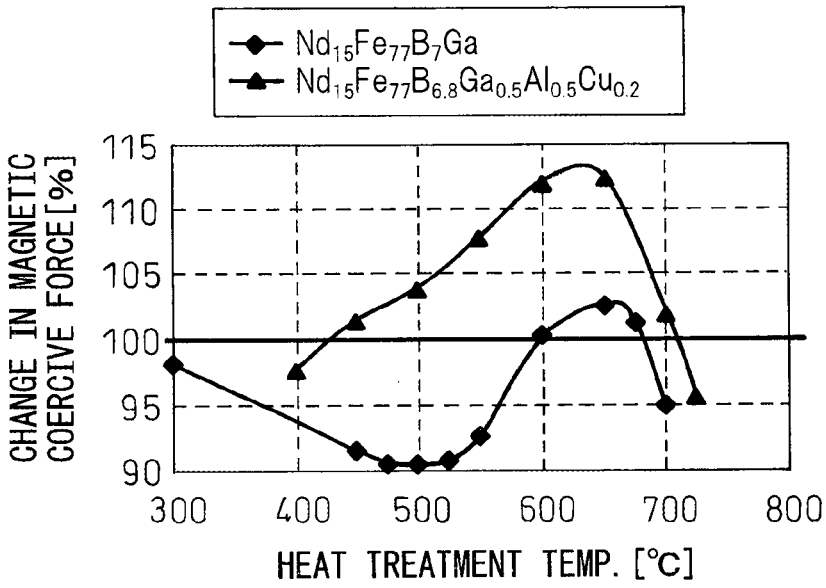
FIG. 5 shows a change in magnetic coercivity (%) of a rare earth magnet having a nanocrystalline structure of the composition $Nd_{15}Fe_{77}B_7Ga$ or the composition $Nd_{15}Fe_{77}B_{6.8}Ga_{0.5}Al_{0.5}Cu_{0.2}$ by heat treatments at various temperatures (Reference Example 1).

With respect to the samples comprising and not comprising Al and Cu, the relationship between the change (%) of magnetic coercive force based on that before heat treatment, and the heat treatment temperature is shown in FIG. 5 and Table 1. In the case that the samples do not comprise Al and Cu, the increase of magnetic coercive force by the heat treatment is seen in the heat treatment temperature range of 600 to 680° C. The ratio of increase is about 3% (about 0.5 kOe) at a maximum. On the other hand, in the case that the samples comprise Al and Cu, the increase of magnetic coercive force by the heat treatment is seen over a wide heat treatment temperature range of 450 to 700° C. The ratio of increase is about 13% at a maximum, and constitutes a significant rise.

TABLE 1

Table 1A: $Nd_{15}Fe_{77}B_7Ga$

| | Temperature (° C.) | | | | | | | | | |
|---|---|---|---|---|---|---|---|---|---|---|
| | 300 | 450 | 475 | 500 | 525 | 550 | 600 | 650 | 675 | 700 |
| Change of Magnetic coercive force (%) | 98.3 | 91.6 | 90.5 | 90.5 | 90.8 | 92.7 | 100.3 | 102.3 | 101.2 | 94.9 |

Table 1B: $Nd_{15}Fe_{77}B_{6.8}Ga_{0.5}Al_{0.5}Cu_{0.2}$

| | Temperature (° C.) | | | | | | | |
|---|---|---|---|---|---|---|---|---|
| | 400 | 450 | 500 | 550 | 600 | 650 | 700 | 725 |
| Change of Magnetic coercive force (%) | 97.8 | 101.5 | 104.1 | 107.9 | 112.2 | 112.4 | 102.1 | 95.8 |

In other words, by the addition of Al and Cu, the temperature range wherein the magnetic coercive force is increased by the heat treatment appears to be expanded, and the increment of the magnetic coercive force is also enhanced. This can be attributed to the fact that the eutectic temperature of Nd—Al or Nd—Cu is significantly lower than the melting point of Nd. That is, it is considered that diffusion or fluidization of the grain boundary phase is greatly accelerated by the introduction of Al and Cu into the grain boundary phase, and thereby the grain boundary phase is redistributed to the crystal grain boundary of the main phase $Nd_2Fe_{14}B$, and prevents the exchange coupling between main phase grains, as a result, the magnetic coercive force is increased.

Reference Example 2

With respect to the sample in Reference Example 1, which was processed up to hot working and comprises Al and Cu, a heat treatment was applied under the following conditions, the magnetic characteristics were measured by VSM, and the effect of holding time in the heat treatment was examined.

<<Heat Treatment Conditions: Various Holding Times>>

Holding temperature: 600° C. (constant)

Heating rate from room temperature to holding temperature: 120° C./min (constant)

Holding time: varied in the range of 10 seconds to 30 minutes

Cooling: quenching

Atmosphere: Ar gas (2 Pa)

Figure 6:
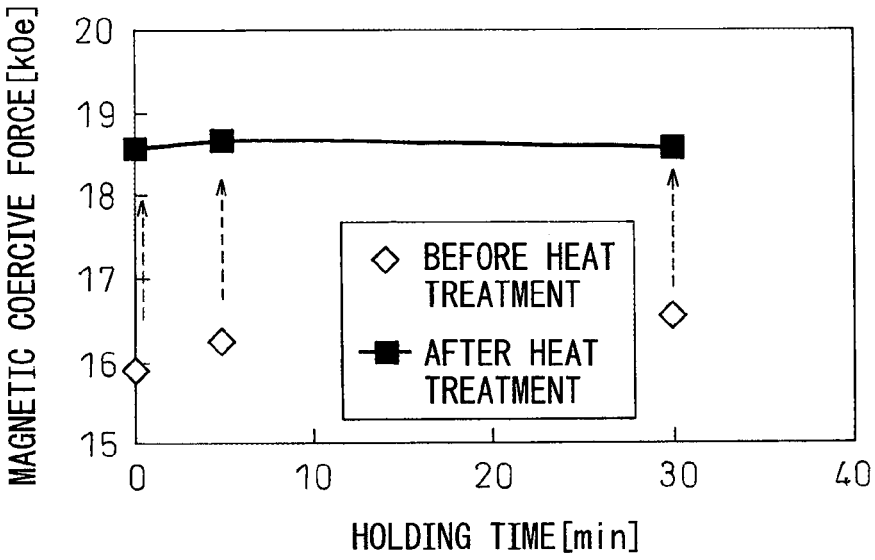
FIG. 6 shows a magnetic coercive force before and after heat treatment of various times of a rare earth magnet having a nanocrystalline structure (Reference Example 2).

The relationship between the magnetic coercive force after heat treatment and the holding time (600° C.×t) is shown in FIG. 6 and Table 2. The magnetic coercive force before heat treatment is also shown. It is seen that the magnetic coercive force is enhanced by the heat treatment even for a short time of 10 seconds, and moreover, this effect is scarcely changed by the heat treatment up to 30 minutes. Conventionally, in the case of a sintered magnet having a crystal grain size of several tens of μm, the holding time in the heat treatment must be from 1 to 10 hours so as to obtain a significant effect. The nanocrystalline magnet above has a crystal grain size of typically around 100 nm (0.1 μm), and the surface area of the crystal grain is smaller by about 2 orders of magnitude than a sintered magnet. For these reasons, the time required for the grain boundary phase to be diffused or fluidized by the heat treatment and cover the crystal grain is considered to be greatly reduced.

TABLE 2

| Holding Time in Heat Treatment (min) | | 0.17 | 5 | 30 |
|---|---|---|---|---|
| Magnetic coercive force (kOe) | After heat treatment | 18.6 | 18.7 | 18.6 |
| | Before heat treatment (*) | 15.9 | 16.3 | 16.5 |

(*) The value before heat treatment is of course irrelevant to the heat treatment, and is shown for confirming the degree of variation among samples before heat treatment.

Reference Example 3

With respect to the sample in Reference Example 1, which was treated up to hot working and comprises Al and Cu, a heat treatment was applied under the following conditions, the magnetic characteristics were measured by VSM, and the effect of the heating rate was examined.

<<Heat Treatment Conditions: Various Heating Rates>>

Holding temperature: 600° C. (constant)

Heating rate from room temperature up to holding temperature: varied in the range of 5 to 600° C./min Holding time: 30 minutes (constant)

Cooling: quenching

Atmosphere: Ar gas (2 Pa)

Figure 7:
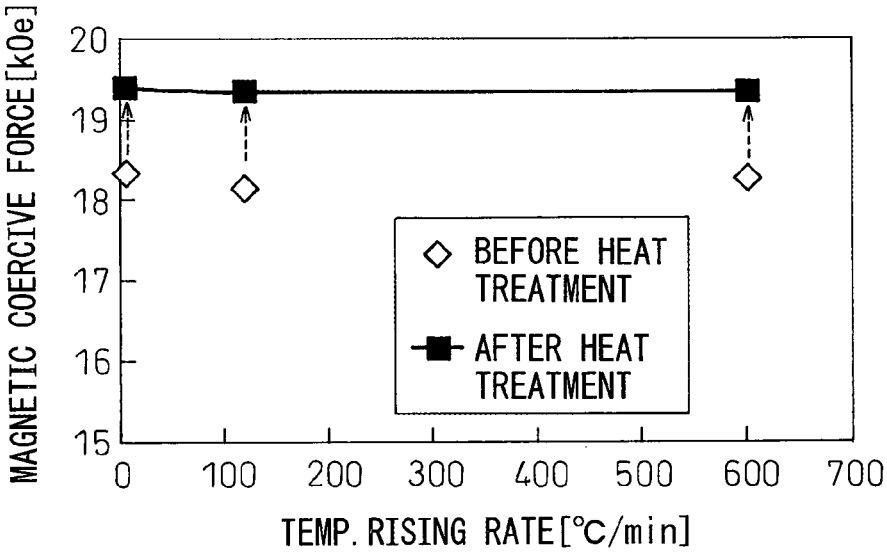
FIG. 7 shows a magnetic coercive force before and after heat treatment at various heating rates of a rare earth magnet having a nanocrystalline structure (Reference Example 3).

The relationship between the magnetic coercive force after heat treatment and the heating rate up to the heat treatment temperature is shown in FIG. 7 and Table 3. The magnetic coercive force before heat treatment is also shown. In this range, the effect of enhancing the magnetic coercive force by the heat treatment shows almost no dependency on the temperature rising rate. In general, when the temperature rising rate is low, this has a risk of coarsening the structure and is considered as disadvantageous. A higher heating rate is preferred from the standpoint of suppressing the coarsening of the structure, and at the same time, reducing the processing time.

TABLE 3

| | | Heating Rate upto Heat Treatment Temperature (° C./min) | | |
|---|---|---|---|---|
| | | 5 | 120 | 600 |
| Magnetic coercive force (kOe) | After heat treatment | 19.4 | 19.3 | 19.3 |
| | Before heat treatment (*) | 18.3 | 18.1 | 18.3 |

(*) The value before heat treatment is of course irrelevant to the heat treatment, and is shown for confirming the degree of variation among samples before heat treatment.

Reference Example 4

With respect to the sample of the composition $Nd_{15}Fe_{77}B_{6.8}Ga_{0.5}Al_{0.5}Cu_{0.2}$ in Reference Example 1, which was treated up to hot working and comprised Al and Cu, a heat treatment was applied under the following conditions, and the structure before and after heat treatment was observed (observed from the a plane) by TEM (transmission electron microscope). The TEM sample was prepared by processing with FIB (focused ion beam) and ion-milling to be a thin flake.

<<Heat Treatment Conditions>>

Holding temperature: 600° C.

Heating rate from room temperature up to holding temperature: 120° C./min

Holding time: 30 minutes

Cooling: quenching

Atmosphere: Ar gas (2 Pa)

Figure 8:
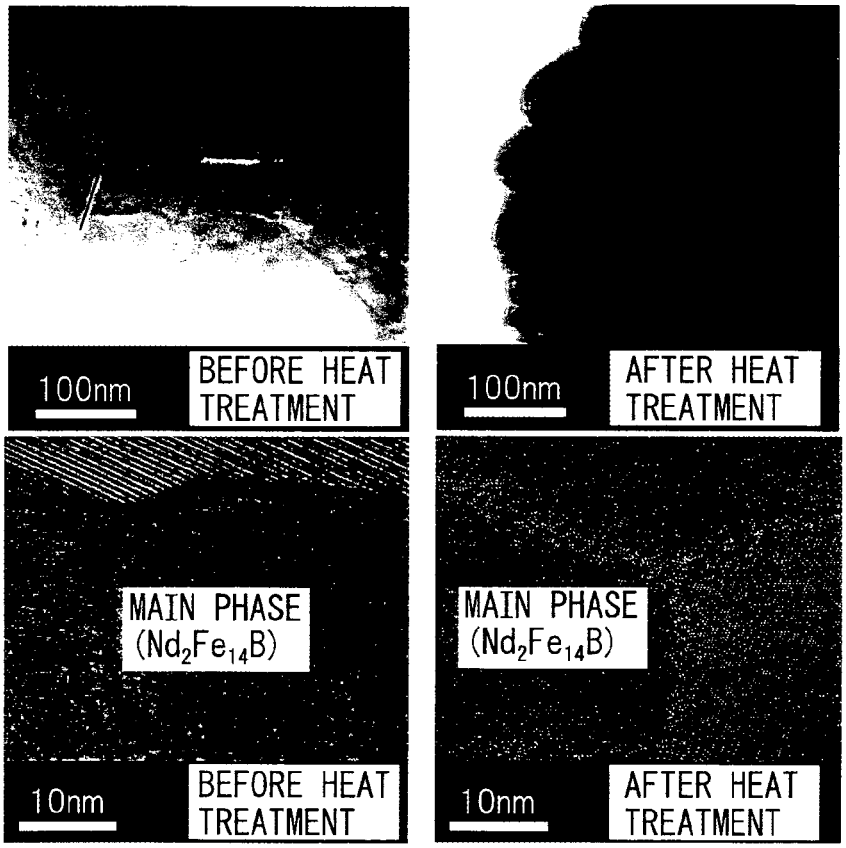
FIG. 8 shows a TEM image of a nanocrystalline structure before and after heat treatment (Reference Example 4). In the figure, the arrow indicates the working direction of the hot working.

FIG. 8 shows the TEM images before and after heat treatment. Before heat treatment, in many portions, adjacent main phase grains are in direct contact with each other at the grain boundary without intervention of a grain boundary phase. In contrast, after heat treatment, the structure was changed such that, in many portions, an amorphous grain boundary phase is present at the grain boundary. The crystal grain size of the main phase was scarcely changed before and after the heat treatment, and was essentially constant.

Figure 9:
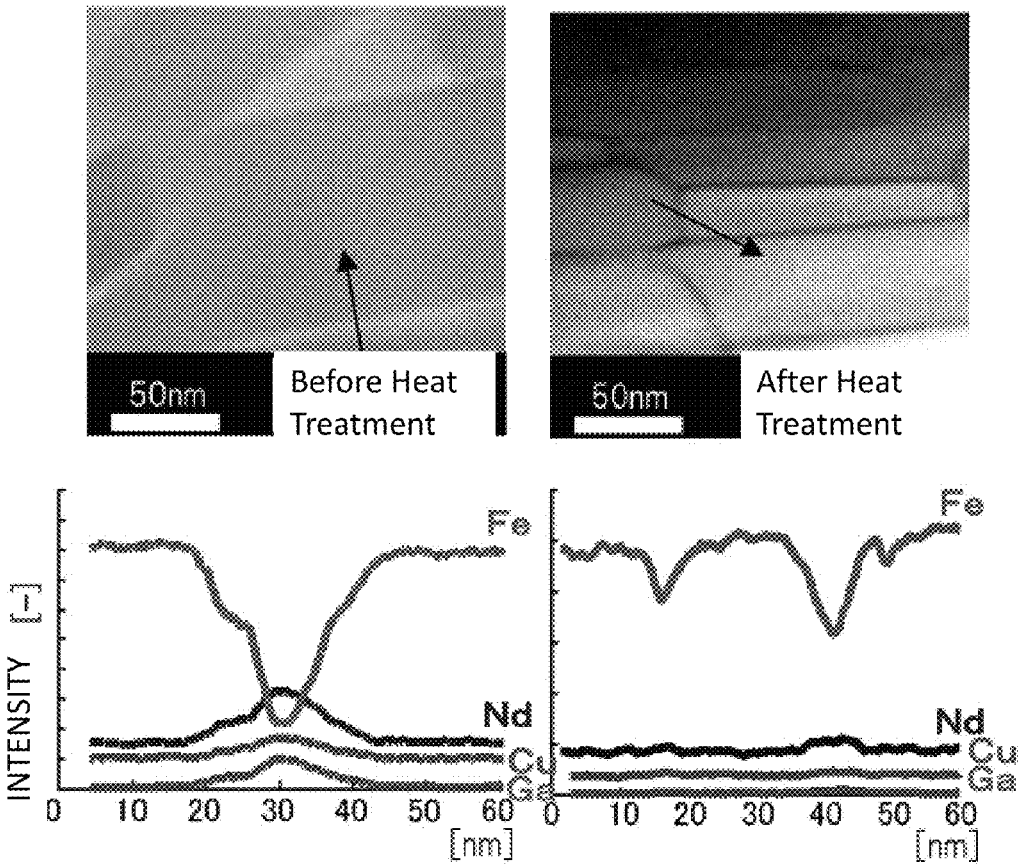
FIG. 9 shows an HAADF image of a nanocrystal structure and an EDX ray analysis chart before and after heat treatment (Reference Example 4). In the figure, the arrow indicates the portion analyzed by EDX ray analysis.

FIG. 9 shows the HAADF image and the EDX ray analysis results. In the HAADF image, the grain boundary before heat treatment appears white, and is considered to be an Nd-rich composition. The same is presumed from the EDX ray analysis results. On the other hand, the grain boundary after heat treatment appears black in the HAADF image, revealing that the electron density therein was decreased. Also, in the EDX ray analysis, the composition of the grain boundary phase after heat treatment is not Nd-rich as compared with the composition before heat treatment.

These observed results indicate that even when the heat treatment is not associated with pressurization, the coverage of the main phase grains by the grain boundary phase is increased, the composition of the grain boundary phase is changed, and the crystallinity may be also changed, after the heat treatment. Such changes of the grain boundary phase due to the heat treatment are considered to prevent magnetic exchange coupling between main phase grains, and to increase the magnetic coercive force.

Example 1

In Example 1 below, it is demonstrated that, according to the method of the present invention for producing a rare earth magnet wherein the heat treatment is associated with pressurization, a rare earth magnet having an improved magnetic coercive force as compared with the case of performing heat treatment with no pressurization is obtained.

A nanocrystalline rare earth magnet of the composition $Nd_{16}Fe_{77.4}B_{5.4}Ga_{0.5}Al_{0.5}Cu_{0.2}$ was produced. The finally obtained structure is a nanocrystalline structure composed of a main phase: $Nd_2Fe_{14}B_1$ phase, and a grain boundary phase: Nd-rich phase (Nd or Nd oxide) or $Nd_1Fe_4B_4$ phase. Ga is enriched in the grain boundary phase to block the movement of grain boundaries, and suppress the coarsening of crystal grains. Both Al and Cu alloys with Nd in the grain boundary phase, and thereby enables diffusion or fluidization of the grain boundary phase.

<Production of Alloy Ingot>

Each raw material of Nd, Fe, FeB, Ga, Al and Cu was weighed to a predetermined amount so as to give the above-described composition, and melted in an arc melting furnace to produce an alloy ingot.

<Production of Quenched Flake>

The alloy ingot was melted in a radio-frequency furnace, and the obtained molten alloy was quenched by ejecting it out on the roll surface of a copper-made single roll, as shown in FIG. 1. The conditions employed are as follows.

<<Quenching Solidification Conditions>>

Nozzle diameter: 0.6 mm

Clearance: 0.7 mm

Ejection pressure: 0.7 kg/cm$^3$

Roll speed: 2,350 rpm

Melting temperature: 1,450° C.

<Separation>

In the obtained quenched flakes (4), as described above, nanocrystalline flakes and amorphous flakes were mixed. Therefore, as shown in FIG. 2, the quenched flakes (4) were separated into nanocrystalline flakes and amorphous flakes by using a low magnetization magnet. More specifically, out of quenched flakes (4) of (1), amorphous quenched flakes were made of a soft magnetic material, and therefore magnetized by the magnet and kept from falling (2), whereas nanocrystalline quenched flakes were made of a hard magnetic material, and therefore not magnetized by the magnet and thus allowed to fall (3). Only fallen nanocrystalline quenched flakes were collected, and subjected to the following treatment.

<Sintering>

The obtained nanocrystalline quenched flakes were sintered by SPS under the following conditions.

<<SPS Sintering Conditions>>

Sintering temperature: 570° C.

Holding time: 5 minutes

Atmosphere: vacuum of $10^{-2}$ Pa

Surface pressure: 100 MPa

As above, a surface pressure of 100 MPa was imposed during the sintering. This is a large surface pressure exceeding the initial surface pressure of 34 MPa which ensures electric current. Using this large pressurization, a sintered density of 98% (=7.5 g/cm$^3$) was obtained at a sintering temperature of 570° C. and a holding time of 5 minutes. In contrast to the conventional sintering without pressurization where a high temperature of about 1,100° C. is required to obtain the same sintered density, the sintering temperature could be greatly lowered.

However, a low melting point phase was formed on one surface of the quenched flake by the use of the single roll method, and this also contributes to the low-temperature sintering. Specifically, the melting point of the main phase $Nd_2Fe_{14}B_1$ is 1,150° C., whereas the melting point of the low melting point phase is, for example, 1,021° C. for Nd and 786° C. for $Nd_3Ga$.

That is, in this Example, the above-described low-temperature sintering at 570° C. could be achieved by the combination of the effect of lowering the sintering temperature due to the pressurization of the pressure sintering (surface pressure: 100 MPa), and the effect of lowering the sintering temperature due to the low melting point phase formed on one surface of the quenched flake.

<Hot Working>

As an orientation treatment, hot working was performed by using an SPS apparatus under the following severe plastic deformation conditions.

<<Hot Working Conditions>>

Working temperature: 650° C.

Working pressure: 100 MPa

Atmosphere: vacuum of $10^{-2}$ Pa

Working degree (Decrease in thickness): 67%

<Heat Treatment>

<<Heat Treatment Conditions>>

Holding temperature: 525° C.

Holding pressure: 0 MPa (no pressurization (reference)), 10 MPa, or 40 MPa

Heating rate from room temperature up to holding temperature: 120° C./min (constant)

Holding time: 1 hour (constant)

Cooling: allow to cool in SPS

Atmosphere: Ar gas (2 Pa)

<Evaluation of Magnetic Properties>

Each of the samples before and after heat treatment was measured by VSM for magnetic characteristics.

Figure 10:
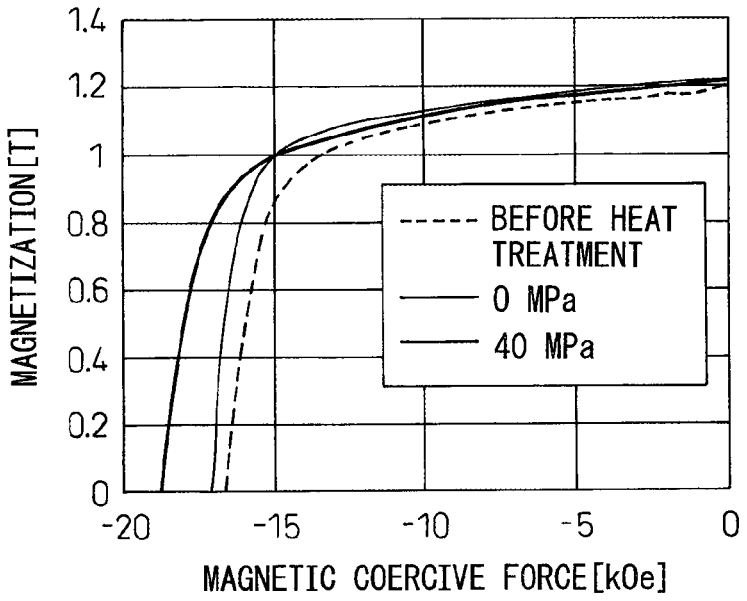
FIG. 10 shows magnetization curves (demagnetization curves) of samples before heat treatment, after heat treatment with no pressurization, and after heat treatment with pressurization at 40 MPa.
Figure 11:
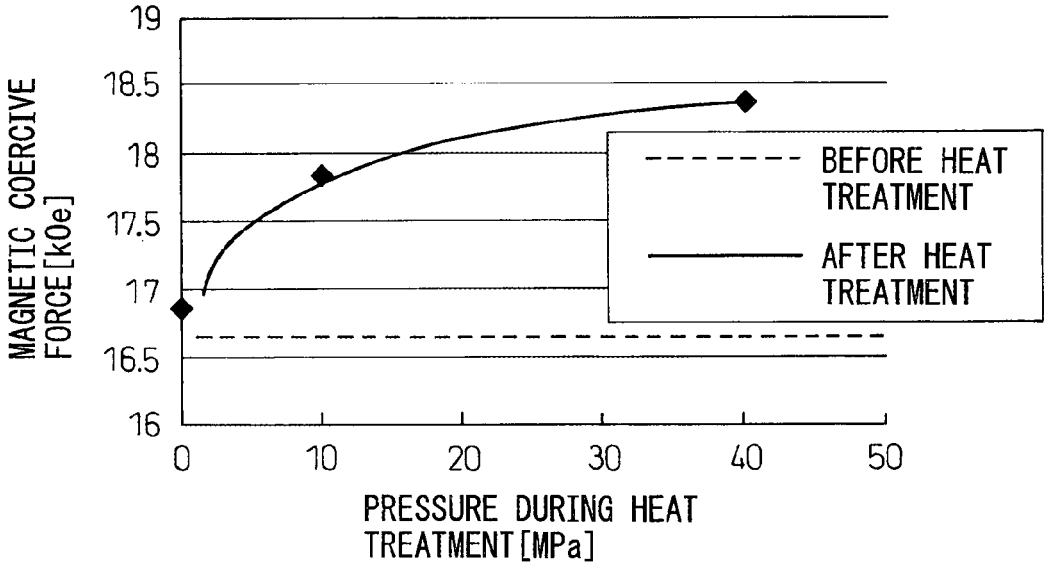
FIG. 11 shows the relationship between the magnetic coercive force before heat treatment or after heat treatment (pressure: 0 MPa, 10 MPa, or 40 MPa), and the pressure at the heat treatment.

FIG. 10 shows magnetization curves (demagnetization curves) of samples before heat treatment, after heat treatment with no pressurization, and after heat treatment with pressurization at 40 MPa. Also, FIG. 11 shows the relationship between the magnetic coercive force before heat treatment or after heat treatment (pressure: 0 MPa, 10 MPa, or 40 MPa), and the pressure at the heat treatment. It is seen from these Figures that the magnetic coercive force was enhanced by the heat treatment, and, in the case of heat treatment with pressurization, the magnetic coercive force was further enhanced in comparison to the heat treatment with no pressurization.

Example 2

In Example 2, the extrusion (pushing-out) effect on the grain boundary phase by pressurization during the heat treatment is demonstrated.

Experimental Method

A Ta buffer layer was deposited on a Si substrate, a NdFeB layer having a thickness of roughly 5 μm was deposited on the Ta buffer layer, and a Ta cap layer was deposited on the NdFeB layer. All depositions were performed at 450° C. using high rate sputtering.

Heat treatment of crystallization was performed at 750° C. Thereafter, the magnetic characteristics were evaluated by Vibrating Sample Magnetometry, and the microstructure was observed by SEM.

Experimental Results

Figure 12:
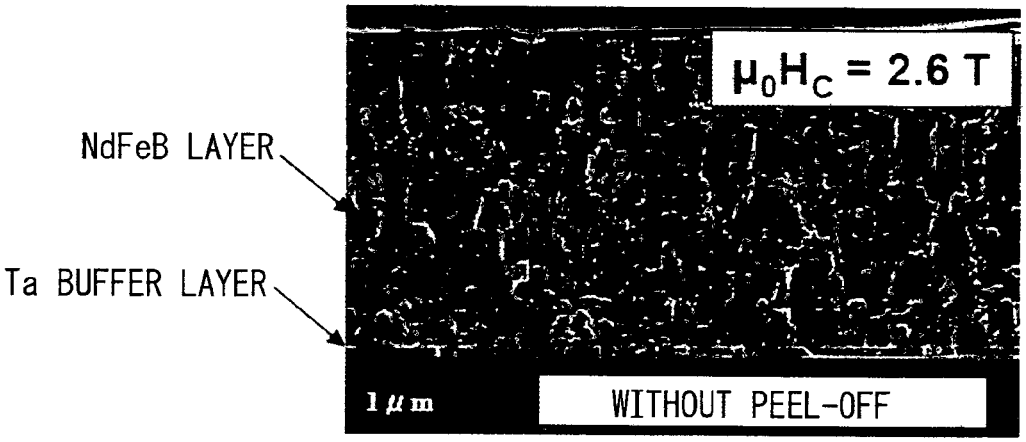
FIG. 12 shows the cross-sectional SEM images and coercivity values of the NdFeB layers.
Figure 12:
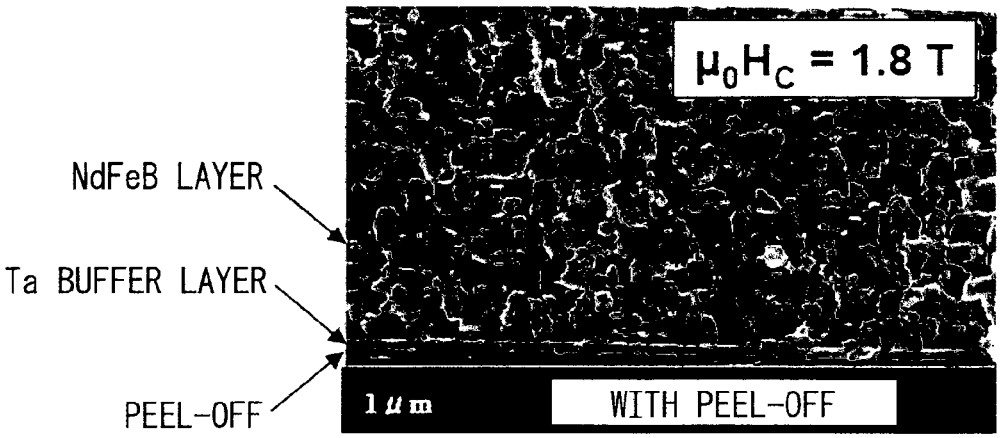
Figure 15:
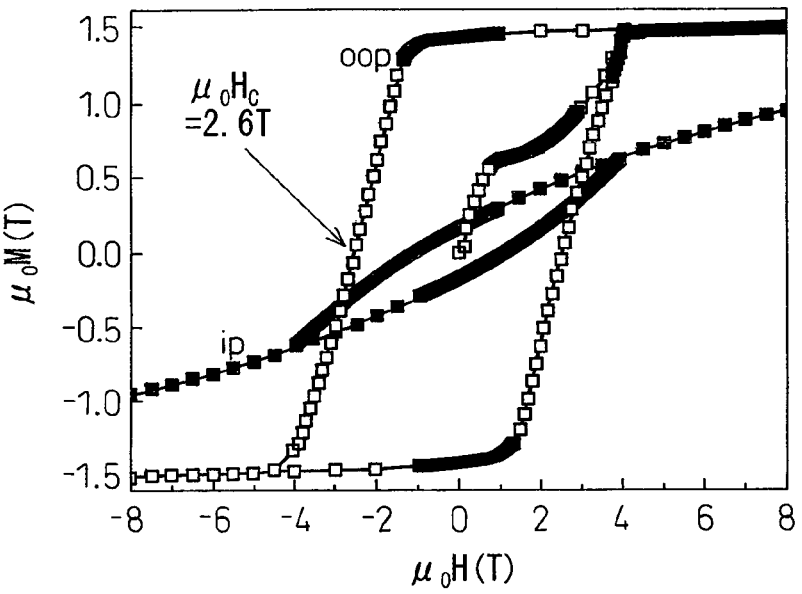
FIG. 15 shows the coercivity measurements of the NdFeB layers.

FIGS. 12 and 15 show the cross-sectional SEM images and coercivity measurements of the NdFeB layers. From this Figure, it can be seen that the low coercivity (18 kOe) film has a poor quality buffer layer-substrate interface, and that the magnetic film has almost fully peeled off the substrate. The degradation of the interface is attributed to diffusion between the Ta layer and the substrate. On the other hand, the high coercivity (26 kOe) film has an intact buffer layer-substrate interface, so that the film is rigidly attached to the substrate.

Figure 13:
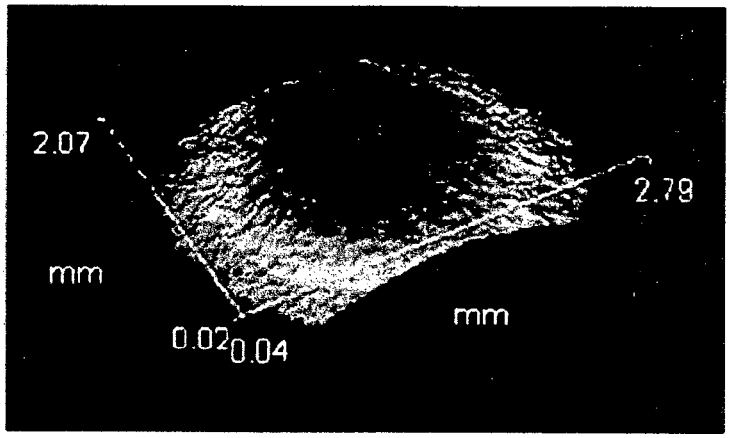
FIG. 13 shows the measurement of substrate-film curvature by optical interferometry.

A difference in thermal expansion coefficients of the substrate and the magnetic film together with phase transformations in the magnetic film during the annealing process leads to a build up of compressive stress in the hard magnetic film. In the case where the magnetic layer peels off the substrate, the compressive stress is relaxed. Incidentally, measurement of substrate-film curvature by optical interferometry (FIG. 13) indicates that the high coercivity film is under a compressive stress of about 250 MPa.

Figure 14:
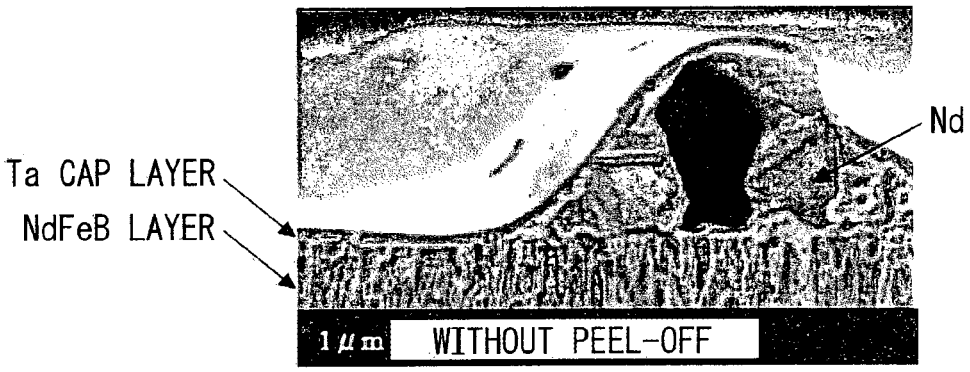
FIG. 14 shows the cross-sectional SEM images of the NdFeB and Ta capping layers.
Figure 14:
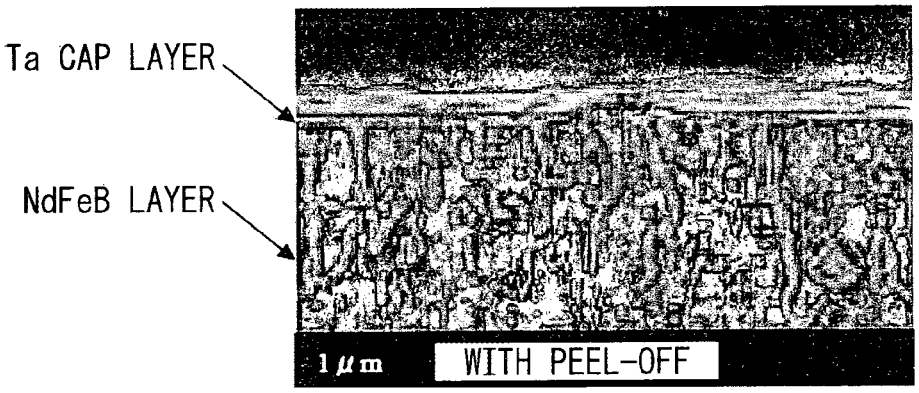

The Nd-rich phase becomes liquid during the post-deposition annealing step. The high level of compressive stress in the fully adhered film leads to a squeezing out of some of the Nd-rich phase from the hard magnetic layer, which in turn creates ripples in the Ta capping layer (FIG. 14 (*a*)). On the other hand, no significant squeezing out occurs in partially released films (FIG. 14 (*b*)). FIGS. 14(*a*) and 14(*b*) are SEM images (secondary electron image). The extrusion of the Nd-rich phase, which leads to the formation of surface ripples, also serves to redistribute the Nd-rich phase around the solid $Nd_2Fe_{14}B$ grains.

The improvement of the magnetic coercive force is attributable to the fact that the grain boundary phase, which is unevenly distributed mainly in triple points among crystal grains of the main phase, is extruded from the triple points due to a compressive stress, and thereby diffusion or fluidization of the grain boundary phase can be accelerated.

INDUSTRIAL APPLICABILITY

According to the present invention, a production method of a rare earth magnet, which is usually represented by a neodymium magnet ($Nd_2Fe_{14}B$) and neodymium magnet films with applications in micro-systems, is provided, wherein a heat treatment method capable of enhancing the magnetic characteristics, particularly the magnetic coercive force, is used.

The invention claimed is:

1. The method for producing a rare earth magnet, comprising:

quenching a molten metal having a rare earth magnet composition to form quenched flakes having nanocrystalline structure, sintering said quenched flakes, subjecting the sintered body obtained to an orientation treatment, and then applying a heat treatment with pressurization to the orientation-treated sintered body at a temperature sufficiently high to enable diffusion or fluidization of a grain boundary phase and, at the same time, low enough to prevent coarsening of the crystal grains;

wherein rare earth magnet being in the form of a bulk.

2. The method for producing a rare earth magnet according to claim 1, wherein the pressure applied during said heat treatment is 1 to 300 MPa.

3. The method for producing a rare earth magnet according to claim 1, wherein the heat treatment is performed for 1 minute to 5 hours.

4. The method for producing a rare earth magnet according to claim 1, wherein the temperature of said heat treatment is a temperature that is higher than the melting point or eutectic temperature of the grain boundary phase and, at the same time, gives a crystal grain size of 300 nm or less after the heat treatment.

5. The method for producing a rare earth magnet according to claim 1, wherein the temperature of said heat treatment is 450 to 700° C.

6. The method for producing a rare earth magnet according to claim 1, wherein an element capable of lowering the temperature at which said grain boundary phase can be diffused or fluidized is added to said rare earth magnet composition.

7. The method for producing a rare earth magnet according to claim 6, wherein said element is an element capable of lowering the melting point or eutectic temperature of the grain boundary phase down to a melting temperature lower than that of Nd.

8. The method for producing a rare earth magnet according to claim 7, wherein said element is selected from Al, Cu, Mg, Fe, Co, Ag, Ni and Zn.

9. The method for producing a rare earth magnet according to claim 1, wherein said rare earth magnet composition is represented by the following compositional formula; and an element capable of alloying with Fe, and thereby lowering the temperature at which the grain boundary phase can be diffused or fluidized, is added to said rare earth magnet composition in an amount sufficiently large to lower said temperature and small enough to cause no deterioration of magnetic characteristics and hot workability:

$$R^1_vFe_wCo_xB_yM^1_z$$

$R^1$: one or more kinds of rare earth elements including Y, $M^1$: at least one of Ga, Zn, Si, Al, Nb, Zr, Ni, Cu, Cr, Hf, Mo, P, C, Mg and V, $13 \le v \le 20$, $w = 100 - v - x - y - z$, $0 \le x \le 30$, $4 \le y \le 20$, $0 \le z \le 3$.

10. The method for producing a rare earth magnet according to claim 9, wherein, in said compositional formula $R^1_vFe_wCo_xB_yM^1_z$, the amount v of $R^1$ (one or more kinds of rare earth elements including Y) is $13 \le v \le 17$, and the amount y of B is $5 \le y \le 16$.

11. The method for producing a rare earth magnet according to claim 9, wherein the main phase of the rare earth magnet is $Nd_2Fe_{14}B$, and an element capable of alloying with Nd of the grain boundary phase and thereby lowering the temperature at which the grain boundary phase can be diffused or fluidized, is added in an amount sufficiently large to lower said temperature and small enough to cause no deterioration of magnetic characteristics and hot workability.

12. The method for producing a rare earth magnet according to claim 1, wherein said rare earth magnet composition is represented by the following compositional formula, and composed of a main phase ($(R^2R^3)_2(FeCo)_{14}B$) and grain boundary phases ($(R^2R^3)(FeCo)_4B_4$ phase and $R^2R^3$ phase); and an element capable of alloying with R and thereby lowering the temperature at which the grain boundary phase can be diffused or fluidized, is added to said rare earth magnet composition in an amount sufficiently large to lower said temperature and small enough to cause no deterioration of magnetic characteristics and hot workability:

$$R^2_aR^3_bFe_cCo_dB_eM^2_f$$

$R^2$: one or more kinds of rare earth elements, excluding Dy and Tb and including Y, $R^3$: one or more kinds of heavy rare earth elements consisting of Dy and Tb, $M^2$: at least one of Ga, Zn, Si, Al, Nb, Zr, Ni, Cu, Cr, Hf, Mo, P, C, Mg, Hg, Ag and Au, $13 \le a \le 20$, $0 \le b \le 4$, $c = 100 - a - b - d - e - f$, $0 \le d \le 30$, $4 \le e \le 20$, $0 \le f \le 3$.

13. The method for producing a rare earth magnet according to claim 1, wherein said orientation treatment is a hot working.

14. The method for producing a rare earth magnet according to claim 1, wherein Ga is added to said rare earth magnet composition.

* * * * *